US009267352B1

(12) United States Patent
Smith

(10) Patent No.: US 9,267,352 B1
(45) Date of Patent: Feb. 23, 2016

(54) SWELL PACKER WITH END RINGS AND CUTTERS

(71) Applicant: LB ENTERPRISES, LLC, Anchorage, AK (US)

(72) Inventor: Lee Morgan Smith, Anchorage, AK (US)

(73) Assignee: ALASKAN ENERGY RESOURCES, INC., Anchorage, AK (US)

( * ) Notice: Subject to any disclaimer, the term of this patent is extended or adjusted under 35 U.S.C. 154(b) by 0 days.

(21) Appl. No.: 14/567,057

(22) Filed: Dec. 11, 2014

Related U.S. Application Data

(60) Continuation-in-part of application No. 14/133,315, filed on Dec. 18, 2013, which is a division of application No. 13/852,861, filed on Mar. 28, 2013, now Pat. No. 8,640,770.

(60) Provisional application No. 61/699,999, filed on Sep. 12, 2012.

(51) Int. Cl.
*E21B 33/12* (2006.01)
*E21B 33/1295* (2006.01)
*E21B 33/128* (2006.01)

(52) U.S. Cl.
CPC ..... *E21B 33/1216* (2013.01); *E21B 33/1208* (2013.01); *E21B 33/1285* (2013.01); *E21B 33/12955* (2013.01)

(58) Field of Classification Search
CPC ..... E21B 33/1208; E21B 33/1216; E21B 33/1277; E21B 33/12955
See application file for complete search history.

(56) References Cited

U.S. PATENT DOCUMENTS

| | | | | |
|---|---|---|---|---|
| 8,074,723 | B2 | 12/2011 | Nutley et al. | |
| 8,235,108 | B2 | 8/2012 | Lemme et al. | |
| 8,640,770 | B1 | 2/2014 | Smith et al. | |
| 8,739,865 | B1 | 6/2014 | Smith et al. | |
| 8,757,299 | B2 * | 6/2014 | DiGiovanni et al. | 175/428 |
| 2003/0010540 | A1 * | 1/2003 | Kirk et al. | 175/325.5 |
| 2009/0283328 | A1 * | 11/2009 | Drivdahl et al. | 175/58 |
| 2010/0263880 | A1 * | 10/2010 | Carter | 166/387 |
| 2010/0300689 | A1 * | 12/2010 | McRobb et al. | 166/285 |
| 2012/0255786 | A1 | 10/2012 | Isenhour | |

FOREIGN PATENT DOCUMENTS

WO 2014092714 A1 6/2014

* cited by examiner

*Primary Examiner* — David Bagnell
*Assistant Examiner* — Tara Schimpf
(74) *Attorney, Agent, or Firm* — Buskop Law Group, PC; Wendy Buskop

(57) ABSTRACT

A swell packer configured to simultaneously cut and seal a wellbore or slide down and seal a wellbore. The swell packer has a swellable wellbore packer section and a pair of end rings. The end rings couple the substantially cylindrical body to the swellable wellbore packer section. Each end ring forms an annular abutment surface that cooperates with the swellable member to inhibit axial movement of the swellable member on the substantially cylindrical body. At least one diamond cutter insert, polyamide button, or tungsten carbide block can be installed circumferentially and spaced apart symmetrically or near-symmetrically on at least one of the end rings.

24 Claims, 6 Drawing Sheets

FIGURE 2G
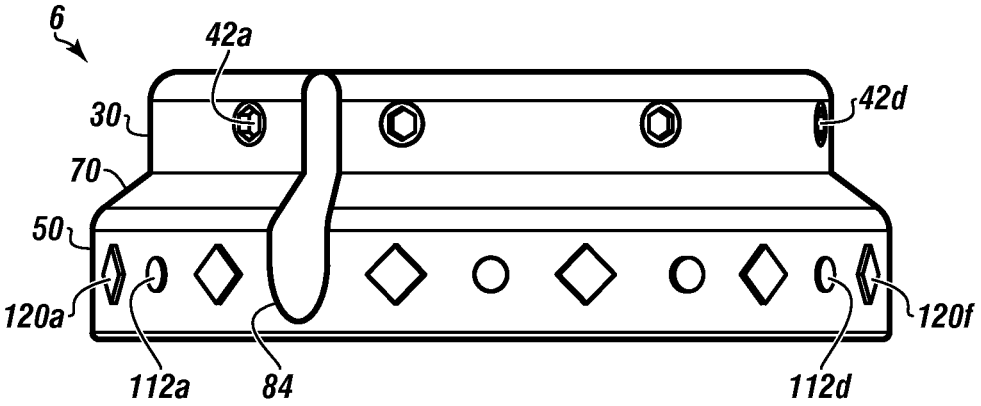
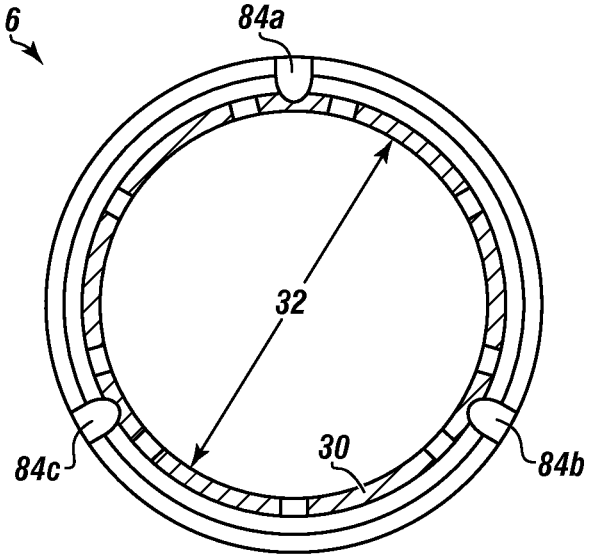
FIGURE 3

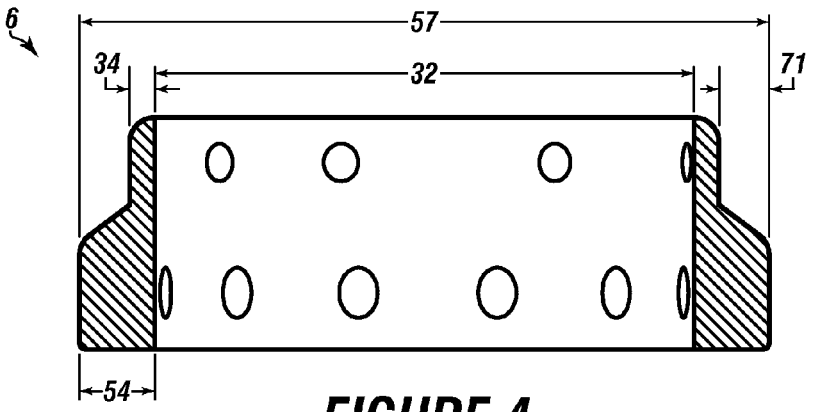
FIGURE 4
FIGURE 5
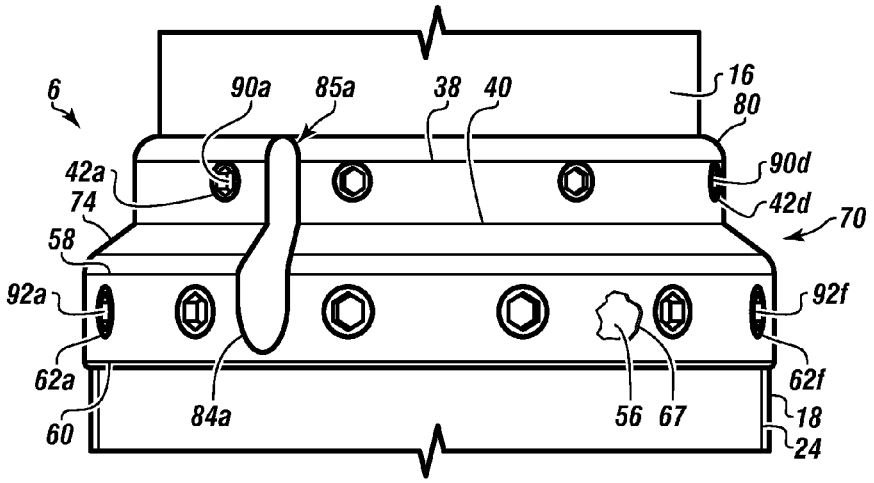
FIGURE 6
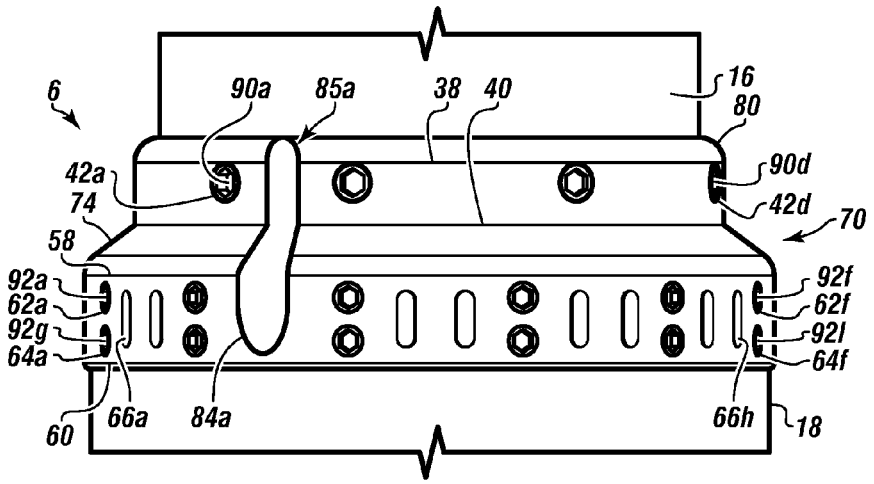

SWELL PACKER WITH END RINGS AND CUTTERS

CROSS REFERENCE TO RELATED APPLICATIONS

The current application is a Continuation in Part of co-pending U.S. patent application Ser. No. 14/133,315 filed on Dec. 18, 2013, entitled "END RING FOR USE WITH FRAC TUBULARS," which is a Divisional and claims priority and the benefit of U.S. patent application Ser. No. 13/852,861 filed on Mar. 28, 2013, entitled "END RING FOR USE WITH SWELL PACKER," now issued as U.S. Pat. No. 8,640,770 on Feb. 4, 2014, which claims priority and the benefit of U.S. Provisional Patent Application Ser. No. 61/699,999 filed on Sep. 12, 2012, entitled "FLANGED END RING FOR USE WITH SWELL PACKERS." These references are incorporated herein in its entirety.

FIELD

The present embodiments generally relate to swell packers configured to cut and seal a wellbore or slide easily through the wellbore and seal the wellbore by the inclusion of various inserts on the end rings.

BACKGROUND

In the field of oil and gas exploration and production, it is common to provide ring members on longitudinal tools, bodies, tubulars or mandrels. Typically, ring members are sized to be slipped on to the tubular or mandrel and moved longitudinally into the desired position where they are secured to the body. A typical function of a ring member is to prevent or restrict axial movement of an adjacent component on the body.

One particular application in which ring members are required is in the construction of swellable packers. A swellable packer includes a mantle of swellable elastomeric material formed around a tubular body. The swellable elastomer can be selected to expand by increasing in volume on exposure to at least one triggering fluid, which can be a hydrocarbon fluid or an aqueous fluid. The design dimensions and swelling characteristics are selected such that the swellable mantle expands to create a fluid seal in the annulus, thereby isolating one wellbore section from another. Swellable packers have several advantages over conventional packers, including passive actuation, simplicity of construction, and robustness in long term isolation applications.

Commonly, a ring member is provided on either side of the swellable mantle. The ring member is secured to the main body of the tool, and is upstanding from the body. The ring member restricts or prevents axial movement of the swellable mantle on the body. It also provides stand-off protection for the swellable mantle and/or adjacent parts of the tool string during run-in. The ring member also provides an annular abutment surface for the swellable mantle which assists in reducing or preventing extrusion of the elastomer due to fluid pressure or pulling, i.e., downward, forces on the tubular. This improves the integrity of the seal provided by the packer.

A need exists for running a swell packer to the bottom of a well without the swell packer jamming or stopping midway.

A need exists for running a swell packer to the bottom of a well or to a target depth without the swell packer catching on the well midway down the borehole.

A need exists for an easy to install end ring for swell packers that allows the swell packers to be easily positioned at the target depth in a wellbore particularly for oil and natural gas wells.

The present embodiments meet these needs.

BRIEF DESCRIPTION OF THE DRAWINGS

The detailed description will be better understood in conjunction with the accompanying drawings as follows:

FIG. 2G depicts a side view of an end ring according to one or more embodiments.

FIG. 3 depicts a cross sectional top view of the end ring depicting the first ring connected to the shoulder and the second ring according to one or more embodiments.

FIG. 4 depicts another cross sectional view of the end ring according to one or more embodiments.

FIG. 5 depicts a side perspective view of an end ring connected to a base pipe and to a rubber tubular of a swell packer according to one or more embodiments.

FIG. 6 depicts a perspective view of another embodiment of an end ring according to one or more embodiments.

Figure 1:
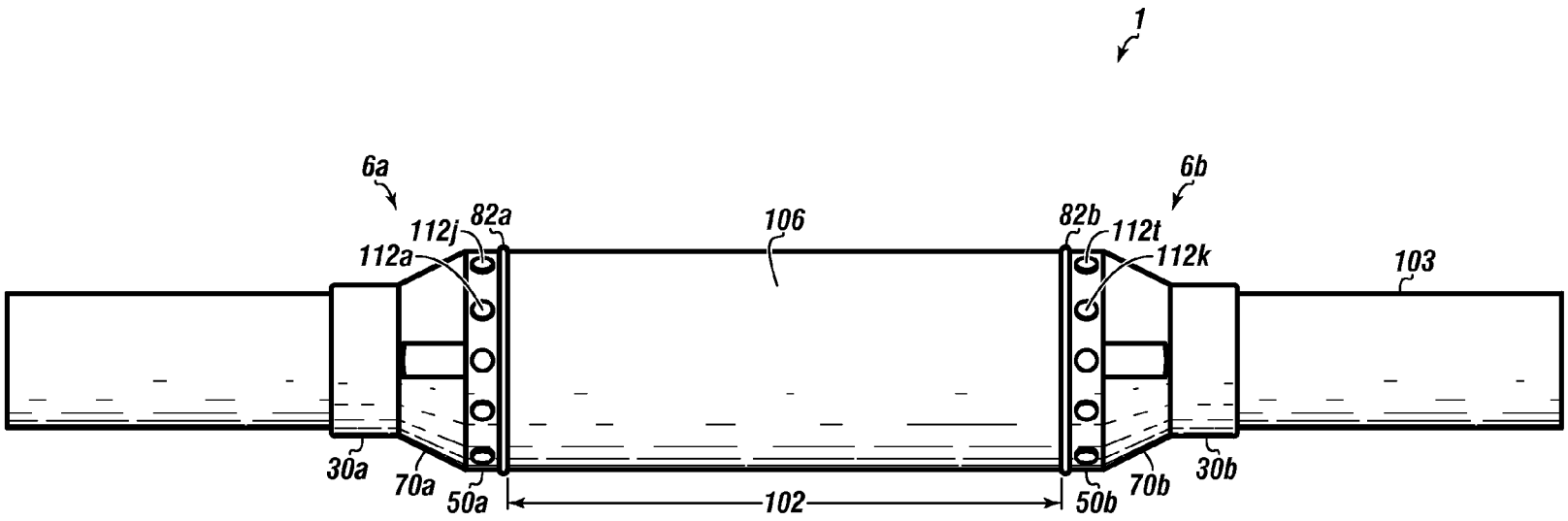
FIG. 1 depicts a swell packer with two end rings according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to swell packers configured to cut the wellbore or slide easily through the wellbore by the inclusion of various inserts on the end rings. The various inserts can include diamond cutter inserts, polyamide buttons, tungsten carbide blocks, and cutting ridges.

The embodiments further relate to a swell packer configured to simultaneously cut and seal a wellbore, or slide down and seal a wellbore having a swellable wellbore packer section, a pair of end rings, wherein the end rings couple the substantially cylindrical body to the swellable wellbore packer section. Each end ring forms an annular abutment surface that cooperates with a swellable member to inhibit axial movement of the swellable member on the substantially cylindrical body. The swell packer has at least one of a plurality of diamond cutter inserts, a plurality of polyamide buttons, and a plurality of tungsten carbide blocks, installed circumferentially and spaced apart symmetrically or near-symmetrically on at least one end ring.

A benefit of the embodied swell packer is that the end rings on the swell packer enable the swell packer to slide into the well to a desired depth without tripping out. Tripping is one of the most dangerous activities at the well site and can kill well site personnel. The use of the end rings on the swell packer can save lives and reduce potential physical injury.

The present embodiments allow a swell packer that is designed to go to the bottom of the well to slide without stopping all the way to the desired depth, which can be the bottom of the wellbore, without separating the liner of the swell packer from the base pipe. When the liner separates from base pipe in a swell packer as the swell packer is run into a well, damage can occur and cause costly trips into the well to retrieve the damaged liner. The end rings on the swell packer can prevent damaging liners to the swell packers.

When a swell packer fails to reach a wellbore bottom, the rig must pull the swell packer back up the wellbore. If the swell packer separates in the wellbore, and comes apart, it can take a rig crew up to three weeks, making multiple trips, to get the liner out of the wellbore. If the crew is unsuccessful fishing the liner from the well, the crew may have to sidetrack the wellbore and drill another hole. Fishing and sidetracking the wellbore and drilling another wellbore can cost millions of dollars. The swell packer with these unique end rings prevents this unnecessary expense.

The embodiments of a swell packer help control unexpected drilling/production costs, and keeps the well production process more safe.

Maximum production occurs when the swell packer with liner intact goes to the bottom of the wellbore. When the swell packer goes to the bottom, drilling costs are minimized and this can help keep the cost for gas cheaper at the pump.

Turning now to the Figures, FIG. 1 depicts a swell packer with two end rings according to one or more embodiments.

The swell packer 1 can have a swellable wellbore packer section 102 can have a substantially cylindrical body 103 and a swellable member 106 disposed on the substantially cylindrical body. The swellable member 106 can be composed of a material selected to expand on exposure to at least one triggering fluid to create a fluid seal in the wellbore annulus.

The swell packer can have two end rings 6*a* and 6*b*. The ends rings 6*a* and 6*b* can slide over the base pipe or drill string and connect edges of the tubular sheath which can be a rubber tubular to the substantially cylindrical body. The end rings 6*a* and 6*b* can form an annular abutment surface or shoulder 70*a* and 70*b* that cooperates with the swellable member 106 to inhibit axial movement of the swellable member 106 on the substantially cylindrical body 103.

The end rings 6*a* and 6*b* can each have a first ring 30*a* and 30*b* and a second ring 50*a* and 50*b*. The second ring 50*a* and 50*b* can be a thicker metal ring with a thickness that can be at least twenty five percent greater than the first ring thickness. The shoulders 70*a* and 70*b* can connect the first ring 30*a* and 30*b* and second ring 50*a* and 50*b*. In embodiments, the shoulder can be straight, angled or stair stepped, depending upon application.

In embodiments, diamond cutter inserts 112*a*-112*j* and 112*k*-112*t* can be disposed on the second rings 50*a* and 50*b*. The diamond cutter inserts can be installed circumferentially and spaced apart symmetrically or near-symmetrically. The diamond cutter inserts aid in cutting the wellbore as the drill string is inserted into the well. The diamond cutter inserts also aid in protecting the swellable member 106 from being snagged or torn by the well or by drill cuttings.

The number of diamond cutter inserts is not limiting to the use; however, more diamond cutter inserts increase the cutting ability of the end rings. The diamond cutter inserts can be symmetrically or near-symmetrically located across the centerline of the second ring or can be in an offset pattern from one another across the centerline of the second ring. The diamond cutter inserts can have a diameter from 50 percent to 100 percent of the width of the second ring. The diamond cutter inserts can also be granular and coated on the face of the second ring. Each diamond cutter insert can extend away from the end ring by 0.001 millimeters to 3 millimeters. The diamond cutter inserts are useful for sliding the swell packer into the wellbore and for preventing the swell packer from becoming stuck in the wellbore.

A second end ring lip 82*a* and 82*b* can be formed on each edge of each second ring 50*a* and 50*b* abutting the swellable member 106. Both end ring lips 82*a* and 82*b* can extend further away from the substantially cylindrical body 103 than the swellable member 106. In embodiments swell packers are installed sequentially in the wellbore. The slight extension provided by the end ring lip protects the swellable member from being snagged or torn by the well of drill cuttings.

The second ring of the end ring can have carbide material on the outer surface as a layer. In one or more embodiments the carbide material can be a layer and/or can be a button of polycrystalline material, such as a diamond material; a PDC material, such as PDC buttons; or PDC cutters, such as those from Guilin Star Diamond Superhard Materials Co., Ltd. of China, which can aid in cutting the wellbore.

Figure 2A:
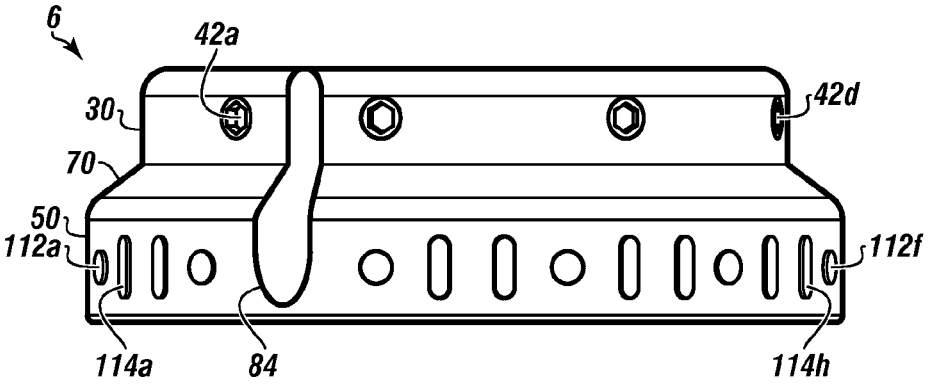
FIG. 2A depicts a side view of an end ring according to one or more embodiments.

FIG. 2A though 2G depict side views of end rings 6 usable according to one or more embodiments.

Each end ring 6 is depicted with the first ring 30, the second ring 50, and the shoulder 70 connecting the first ring 30 and the second ring 50. Fastener holes 42*a*-42*d* are depicted on the first ring 30, but as discussed further herein, can be located on the second ring 50, as well. A flute 84, though multiple flutes can exists, can be formed in the first ring 30 of each end ring 6. The flutes allow the passage of particulate as the end ring, when attached to the swell packer, is pushed down a wellbore in a direction opposite the direction of insertion of the swell packer.

In FIG. 2A, the diamond cutter inserts 112*a*-112*f* are depicted in conjunction with cutting ridges 114*a*-114*h*. Both the diamond cutter inserts and the cutting ridges can be spaced apart symmetrically or near-symmetrically around the second ring 50.

Figure 2B:
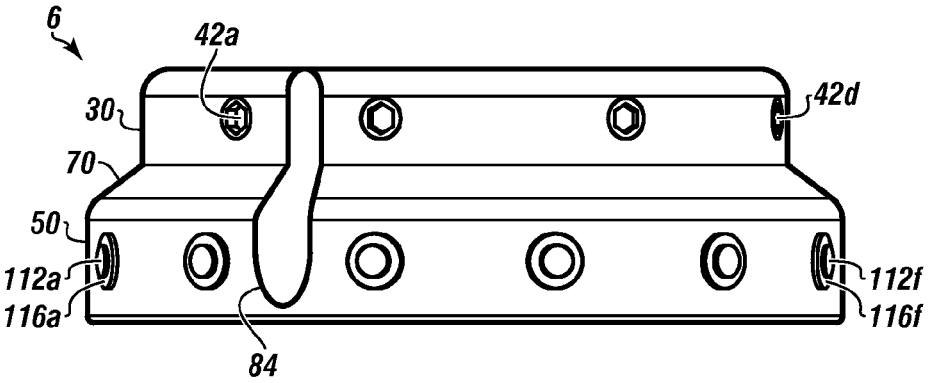
FIG. 2B depicts a side view of an end ring according to one or more embodiments.

In FIG. 2B, the diamond cutter inserts 112*a*-112*f* are depicted with metal rings 116*a*-116*f* surrounding each diamond cutter insert 112*a*-112*f*. The diamond cutter inserts with metal rings can be spaced apart symmetrically or near-symmetrically around the second ring 50. Each metal ring can have a thickness that is from 10 percent to 50 percent the thickness of the diamond cutter insert. The metal ring can be composed of a Group IV metal from the periodic table or a comparable material. If metal rings are used, the metal rings can be located on all or some of the diamond cutter inserts. The metal rings can be alloys.

Figure 2C:
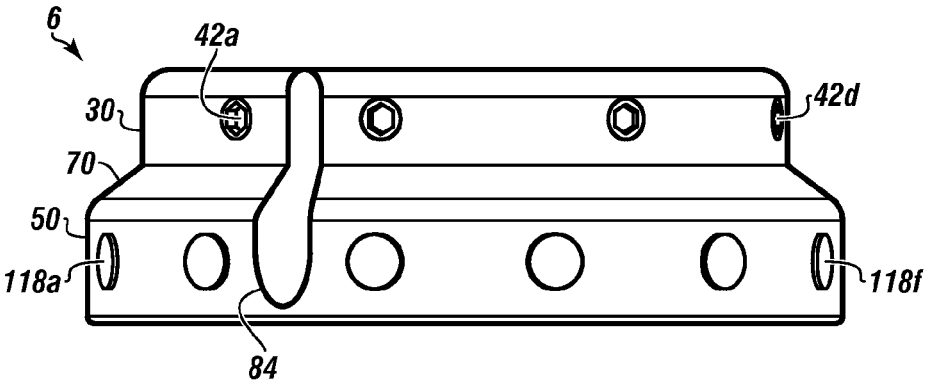
FIG. 2C depicts a side view of an end ring according to one or more embodiments.

In FIG. 2C, polyamide buttons 118*a*-118*f* can be installed circumferentially and spaced apart symmetrically or near-symmetrically on the second ring 50. The polyamide buttons provide for a lower coefficient of friction. The polyamide buttons can be composed of Teflon, nylon or a comparable material that enhances the ability of the swell packer to slide to the bottom of the wellbore.

The number of polyamide buttons is not limited. A greater number of polyamide buttons lowers the coefficient of friction. The polyamide buttons can be symmetrically or near-symmetrically located across the centerline of the second ring or can be installed on the second ring in an offset pattern from one another across the centerline of the second ring. The polyamide buttons can have a diameter from 50 percent to 100 percent of the width of the second ring. Each polyamide buttons can extend away from the end ring by 0.001 millimeters to 3 millimeters Like the crystalline material depicted in FIG. 2B for the diamond cutter inserts, cutting ridges can be included on the second ring with the polyamide buttons.

This swell packer configuration reduces the amount of downhole weight needed to be applied to the swell packers, which is an important safety feature of the invention. It is important that these swell packers slide to bottom of the wellbore with a minimum amount of weight as there is a finite amount of weight to apply to a drill string to set packers.

Even though the Figures depict the diamond cutter inserts as round and the polyamide buttons as elliptical, the polyamide buttons and/or the diamond cutter inserts can be either round or elliptical in shape.

Figure 2D:
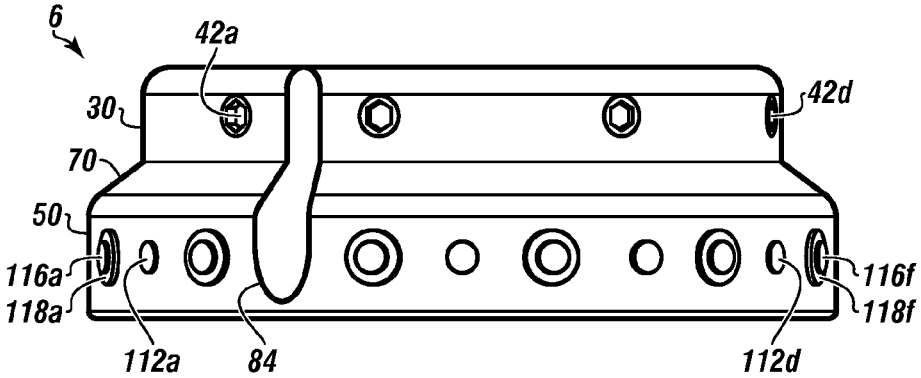
FIG. 2D depicts a side view of an end ring according to one or more embodiments.

In FIG. 2D, shows a combination of diamond cutter inserts 112*a*-112*d* and polyamide buttons 118*a*-118*f* which can be installed circumferentially and spaced a part in an alternating pattern symmetrically or near-symmetrically on the second ring 50.

FIG. 2D also depicts the metal rings 116*a*-116*f* surrounding each of the polyamide buttons 118*a*-118*f*. The embodiments contemplate that an alternating pattern is not limiting to the use and any combination or pattern of diamond cutter inserts and polyamide buttons can be used.

Figure 2E:
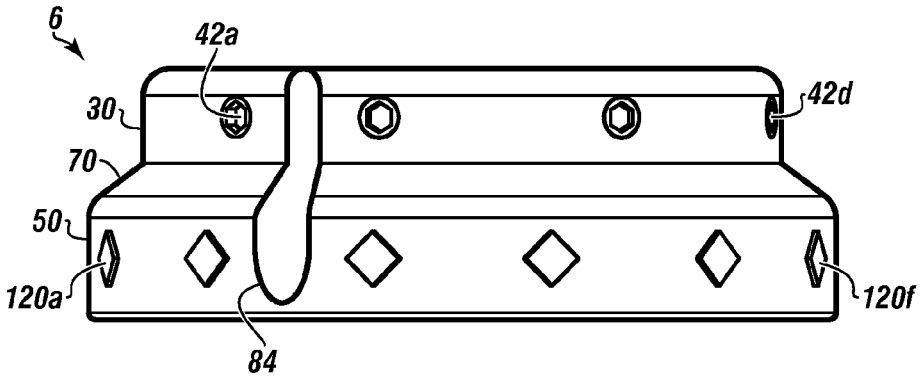
FIG. 2E depicts a side view of an end ring according to one or more embodiments.

In FIG. 2E, tungsten carbide blocks 120*a*-120*f* can be installed circumferentially and spaced apart symmetrically or near-symmetrically on the second ring 50. The tungsten carbide blocks provide for superior cutting and weight transfer. The tungsten carbide blocks can be composed of a matrix of polycrystalline tungsten in carbide or in comparable material.

Figure 2F:
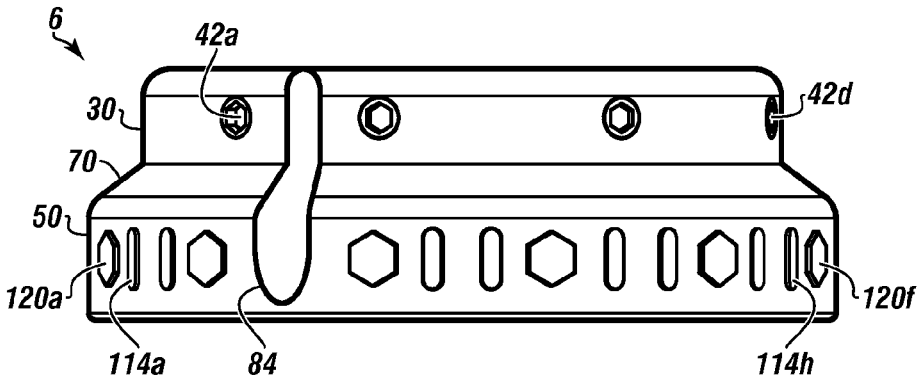
FIG. 2F depicts a side view of an end ring according to one or more embodiments.

The number of tungsten carbide blocks is not limiting to a specific number; however, more tungsten carbide blocks such as from 3 blocks to 20 blocks can be used on a second ring of the end rings. The tungsten carbide blocks can be symmetrically or near-symmetrically located across the centerline of the second ring or can be in an offset pattern from one another across the centerline of the second ring. The tungsten carbide blocks can have a diameter from 50 percent to 100 percent of the width of the second ring. Each tungsten carbide block can extend away from the end ring by 0.001 millimeters to 3 millimeters In FIG. 2F, tungsten carbide blocks 120*a*-120*f* and cutting ridges 114*a*-114*h* can be installed circumferentially and spaced apart in an alternating pattern symmetrically or near-symmetrically on the second ring 50. The tungsten carbide blocks can be in any polygonal shape. FIG. 2F depicts the tungsten carbide blocks in a hexagonal pattern as opposed to the diamond pattern depicted in FIG. 2E.

In FIG. 2G, tungsten carbide blocks 120*a*-120*f* and diamond cutter inserts 112*a*-112*f* can be installed circumferentially and spaced apart in an alternating pattern symmetrically or near-symmetrically on the second ring 50*a*. The embodiments, an alternating pattern can be used, but any combination or pattern of diamond cutter inserts and tungsten carbide blocks can be used. The density of the tungsten carbide blocks and diamond cutter inserts can vary along the end ring.

FIGS. 2A through 2G are examples of some of the combinations of various the embodiments herein. Any combination of the diamond cutter inserts, polyamide buttons, tungsten carbide blocks, and cutting ridges can be used. In embodiments, the diamond cutter inserts, polyamide buttons, tungsten carbide blocks, and cutting ridges can be located on the first ring 30 or on the shoulder 70 of the end ring.

With respect to the end rings and the swellable packer, an end ring has a first ring with an inner diameter and a second ring with the same inner diameter as the first ring. The second ring can have a thickness twenty-five percent greater than the first ring thickness and can be connected to the first ring using a shoulder. The first ring and the second ring can be metal.

The shoulder can have an inner diameter that is identical to the first ring inner diameter. The shoulder can have a sloped outer surface connecting the first ring to the second ring.

One or more flutes can be tapered in embodiments and can be formed in an outer surface of the end ring. The flutes allow the passage of particulate as the end ring is pushed down a wellbore in a direction opposite the direction of insertion of the swell packer.

The flutes around the edges of the end ring can allow lower hydraulic pressure in the well as the swell packers are run into the wellbore while not breaking the formation down as the swell packers are installed and not hanging up the packers in the wellbore.

In embodiments, the end rings can be 0.0125 millimeters larger in diameter than the rubber tubular of the swell packer. In an embodiment in which the diameter of the rubber tubular is 5.675 inches, the end rings can be 5.70 inches in diameter, that is, 0.025 inches larger than the rubber tubular of the swell packer.

One or more fastener holes can be formed in each of the first ring and second ring. The fastener holes can differ in diameter. In the first ring, which can be thinner, the fastener holes can be smaller in diameter than in the second ring, which can be thicker.

The end rings can have, in addition to a single row of fastener holes, a second row or additional rows of fastener holes, which can be created in each ring. Each fastener hole can contain a fastener. Each fastener can be used to help the swell packer sustain the pressure without shredding. The fastener holes in the end ring can be used to ream the wellbore.

The end ring can be made with a layer of carbide material on the outside surface. The carbide material can be used as the cutting material to ream the ledges around the wellbore allowing the swell packers to be installed to a maximum wellbore depth. In one or more embodiments, the end rings can be used with twenty to eighty swell packers in line in a single run.

In one embodiment, the multiple rows of fastener holes can be in the thicker second ring only and still facilitate the end ring sustaining a high pressure of 8000 psi to 10000 psi for the swell packer without having the rings separate from the liner or the liner separate from the base pipe.

For installation on a swell packer, the end ring can be slid over a first end of a base pipe and fasten together the base pipe and edges of a rubber tubular surrounding the base pipe. The rubber tubular exterior can be a hard high durometer material capable of withstanding pressures from 100 psi to 10,000 psi and temperatures from 100 degrees Fahrenheit to 500 degrees Fahrenheit.

The end rings can include flutes that are cut in the outside of the end rings. These "cuts" or "flutes" allow well particulate and well fluid to pass by the end rings instead of grabbing at the liner and sticking to the liner in the wellbore, stopping swell packer penetration. The flutes can enable drilling fluid to flow out of the well as the swell packer is run into the well increasing the chance for the swell to land, intact, where needed in the wellbore. The flutes can vary in number. For example, from two to six flutes can be formed in each end ring, though in some embodiments, up to twenty flutes can be used.

An end ring can have a first end ring lip on an end of the first ring opposite the shoulder. The end ring can have a second end ring lip on the end of the second ring opposite the shoulder. The end ring lips can ensure particulate continues to smoothly flow over the end ring without getting stuck on the end ring or on the rubber tubular of a swell packer. The end ring lips can be beveled.

The end rings can be beveled on all edges, which can prevent the device from hanging up or getting caught while running into and out of a wellbore.

The end ring can use cutting elements, such as cutting ridges on the outer surfaces of the end rings and shoulder, particularly on the larger of the two end rings. The cutting ridges help ream the wellbore, help keep the wellbore clear, and allow drill cuttings to pass by the liner without tearing the liner to shreds.

The cutting elements can be formed on an outer surface of an end ring, allowing the swell packer to be slowly worked into the well while simultaneously reaming the wellbore as the liner portion of the swell packer is run to the bottom or target depth of the well.

The end ring can be used to bidirectionally ream a wellbore with a wellbore axis, reaming in two directions: (i) into a wellbore and (ii) out of a wellbore. The end ring can allow swell packers to go to the bottom of a wellbore very easily, at least ten percent more easily than known swell packers without the end ring.

The end rings for swell packers also prevent the rubber on the base pipe of the swell packer from expanding longitudinally and enable the rubber to expand perpendicular to the base pipe so as to seal off the wellbore, which helps during stimulation of production from the well. A benefit of the end rings is to control swelling longitudinally.

Most swell packers handle only 5000 psi. When two end rings are installed on a base pipe and connected to the rubber tubular, these end rings can enable a swell packer to accommodate pressure in the well of 5000 psi to 10000 psi.

The swell packer can have a base pipe with a first end and a second end, and a swell packer material disposed over the base pipe which can be a rubber tubular. Other polymers can be used as the rubber tubular, provided the polymer can swell in the presence of a well fluid pumped down the wellbore while the swell packer is in the wellbore.

For the swell packer, a first end ring can be fastened between the base pipe and the swell packer first end; a second end ring can be fastened between the base pipe and the swell packer second end; and a collar can typically be connected to the second end of the base pipe.

In one or more embodiments, the second ring of the end ring can be slightly thicker, such as ten percent, and larger in outer diameter than the outer diameter of the rubber tubular of the swell packer. This configuration of the end ring can allow the swell packer to run smoothly into and out of the wellbore, wherein the weight can be distributed onto the end ring. In this embodiment, the swell packer can ride or move on the end ring, which can in turn protect the rubber tubular.

In another embodiment, the diameter of the rubber tubular can be from 0.010 inches to 0.5 inches, and the end ring can have a diameter of five percent to ten percent larger than the rubber tubular of the swell packer.

In an embodiment using the double row of fasteners to hold the end ring, the end ring can be used to prevent the rubber of the swell packer from expanding laterally and to control rubber swelling to a direction perpendicular to the axis of the wellbore or drill pipe, thereby providing a higher pressure seal.

The end rings can also be used for fractionation strings, which are fastened together frac tubulars. The frac strings are used in fracking wells to stimulate production.

The swell packers can be installed in a wellbore by well rig hands that do not need any extra training on how to fish liners out of the hole.

FIG. 3 is a cross sectional top view of the end ring depicting the first ring connected to the shoulder and the second ring according to one or more embodiments.

The end ring 6 with the first ring 30 having an inner diameter 32 is shown. The second ring can have the same inner diameter 32, but a thickness almost twice as wide as the first end ring. Three flutes 84*a*, 84*b*, and 84*c* are depicted formed through the entire width of the end ring and extending into a portion of the first ring.

FIG. 4 is another cross sectional view of the end ring according to one or more embodiments.

The end ring 6 with the inner diameter 32 is shown along with the first ring thickness 34 and second ring thickness 54. The shoulder thickness 71 of the shoulder 70 is also depicted. The second ring outer diameter 57 is also shown.

The end rings are usable with swell packers, which can be made from a central metal tubular, such as a base pipe, with a rubber exterior tubular disposed over the base pipe. In a swell packer, the rubber exterior tubular swells in the presence of a well completion fluid, such as water or oil, or in the presence of other well drilling fluids.

FIG. 5 shows a side perspective view of an end ring connected to a base pipe and to a rubber tubular of a swell packer according to one or more embodiments.

The end ring 6 can sealingly engage one end of the rubber exterior tubular 18 disposed over the base pipe 16. A flute 84*a* with a tapered end 85*a* can be formed in the exterior side of the end ring.

The Figure shows fastener holes 42*a*-42*d* in the first ring and fastener holes 62*a*-62*f* in the second ring. Four fasteners 90*a*-90*d* and 92*a*-92*f* are shown installed in the fastener holes. The fasteners can be screws. Each fastener in the first ring can attach to the base pipe 16. Each fastener in the second ring can attach to the rubber exterior tubular 18. The amount of fastener holes on the first ring can differ from the amount of fastener holes on the second ring.

In this embodiment, the end ring can engage a diffuser layer 24 positioned around the rubber tubular of the swell packer. The shoulder 70 can have a sloped outer surface 74. The shoulder 70 can be disposed between the second ring first edge 58 and the first ring second edge 40. The first ring first edge 38, the first ring second edge 40, the second ring first edge 58, the second ring second edge 60, and a first end ring lip 80 are also shown. The first ring can have an outer diameter ranging from 1 inch to 36 inches. In an embodiment, the edges of the rings can have teeth, such as razor like jagged teeth, to better grip the rubber of the swell packer.

Two flutes to twenty flutes can be used per end ring. The flutes can each have a depth from five percent to fifty-five percent of the thickness of one of the end rings. The end rings can be made from stainless steel. The cutting layer can be carbide. Carbide material 67 is shown on the second ring outer surface 56.

In an embodiment, the first ring can be made from a first material and the second ring can be made from a different material to provide for different physical properties, such as improved durometer and/or better gripping.

FIG. 6 is a perspective view of another embodiment of an end ring according to one or more embodiments.

The end ring 6 is shown with a double row of fastener holes.

The end ring 6 in this Figure is similar to the end ring shown in FIG. 5, but, in this embodiment, the end ring has a second row of second ring fastener holes 64*a*-64*f* in addition to the first row of second ring fastener holes 62*a*-62*f*.

First diameter fasteners 92*a*-92*d* for the first row of second ring fastener holes and second diameter fasteners 92*g*-921 for the second row of second ring fastener holes are shown.

Cutting ridges 66*a*-66*h* are shown formed on an outer surface of the second ring. The second ring second edge 60; the rubber exterior tubular 18; the sloped outer surface 74 of the shoulder 70, the second ring first edge 58, the base pipe 16, the first end ring lip 80; a flute 84*a* with a tapered end 85*a*; the first ring first edge 38; the first ring second edge 40; first ring fastener holes 42*a*-42*d*; and fasteners 90*a*-90*d* on the first ring are also shown in this Figure.

Figure 7:
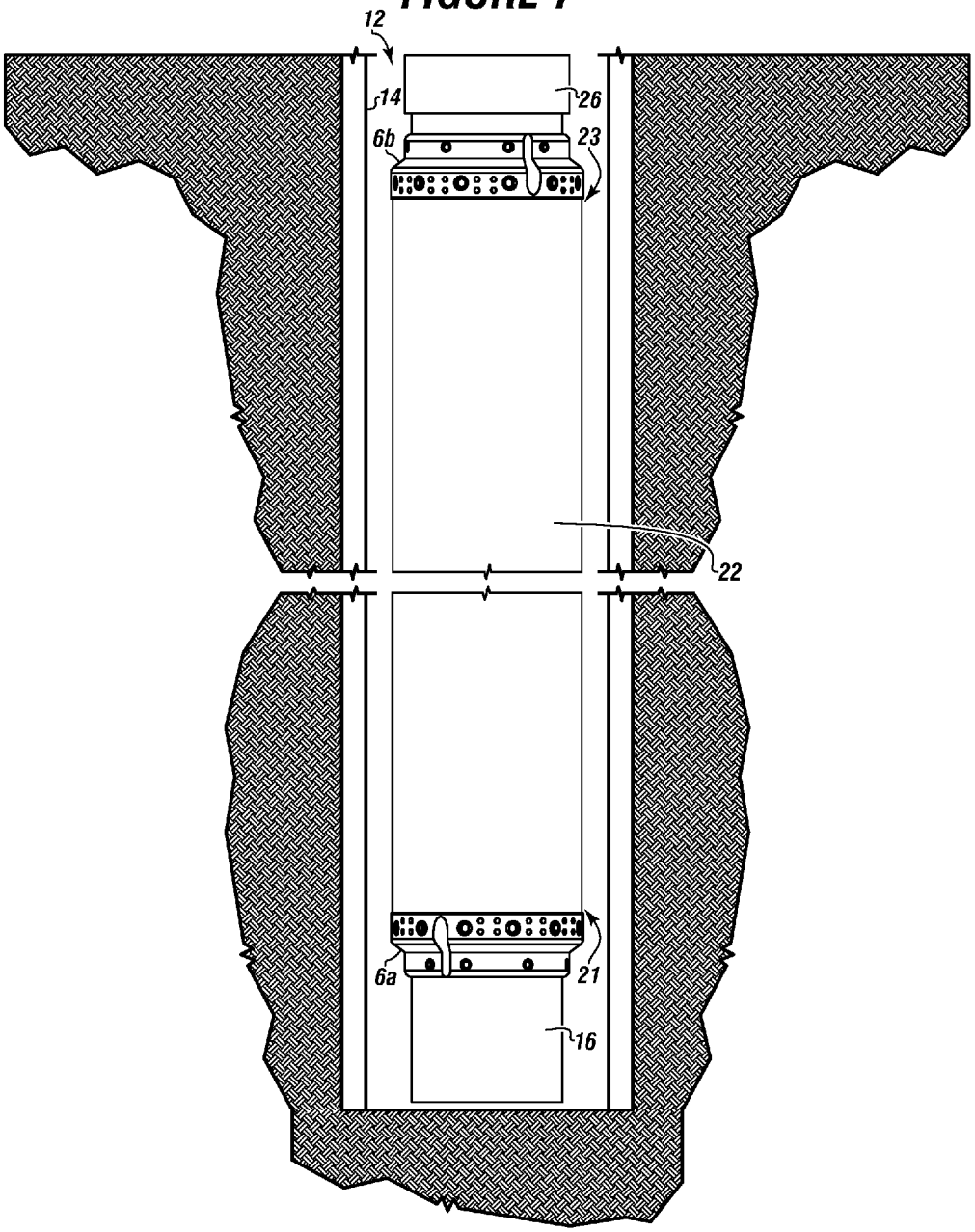
FIG. 7 depicts a swell packer with two end rings secured thereto in a wellbore according to one or more embodiments.

FIG. 7 depicts a swell packer with two end rings secured thereto in a wellbore according to one or more embodiments.

The swell packer 12 can have a first end 21 and a second end 23 in a wellbore 14. The swell packer 12 can be made from the base pipe 16, a tubular sheath 22, a first end ring 6*a* and a second end ring 6*b*. The end rings can engage the edges of the tubular sheath 22 and the base pipe 16 simultaneously. The swell packer can have a collar 26 on the end furthest from wellbore depth.

Two end rings can be used to connect two different swell packers together, such as one end ring for an oil swell packer and one end ring for a water swell packer. The two end rings can also be used to connect a fresh water swell packer to a salt water swell packer.

A method of forming a swellable packer on a well string can comprise providing a swellable member on a substantially cylindrical body of the swellable packer, wherein the swellable member can be composed of a material selected to expand on exposure to at least one triggering fluid to create a fluid seal in a wellbore annulus. An end ring can be coupled to the substantially cylindrical body on each end of the swellable member. The end rings can be secured such that the end forms an annular abutment surface that cooperates with the swellable member.

While these embodiments have been described with emphasis on the embodiments, it should be understood that within the scope of the appended claims, the embodiments might be practiced other than as specifically described herein.

What is claimed is:

1. A swell packer configured to simultaneously cut and seal a wellbore, comprising:

a. a swellable wellbore packer section comprising:

(i) a substantially cylindrical body; and (ii) a swellable member disposed on the substantially cylindrical body, the swellable member comprising a material selected to expand on exposure to at least one triggering fluid to create a seal in the wellbore;

b. a pair of end rings sealingly engage the substantially cylindrical body to the swellable wellbore packer section, wherein each of the end ring forms an annular abutment surface that cooperates with the swellable member to inhibit axial movement of the swellable member on the substantially cylindrical body, wherein each of the end rings comprises a first ring and a second ring, a shoulder having a circumferentially contiguous interior surface between the first ring and the second ring, and fasteners mounted through the first ring and the second ring respectively; and c. a plurality of diamond cutter inserts installed circumferentially and spaced apart symmetrically or near-symmetrically on at least one of the end rings.

2. The swell packer of claim 1, wherein each of the end rings further comprises an end ring lip that extends further away from the substantially cylindrical body than the swellable member.

3. The swell packer of claim 1, further comprising a plurality of cutting ridges formed on at least one of the end rings.

4. The swell packer of claim 1, wherein each of the diamond cutter inserts has a diameter from 50 percent to 100 percent of the width of the second ring.

5. The swell packer of claim 1, wherein each of the diamond cutter inserts extends away from the end ring by 0.001 millimeters to 3 millimeters.

6. The swell packer of claim 1, further comprising a metal ring around at least one of the diamond cutter inserts.

7. The swell packer of claim 6, wherein the metal ring comprises a thickness that is from 10 percent to 50 percent the thickness of at least one of the diamond cutter inserts.

8. The swell packer of claim 6, wherein the metal ring is composed of a Group IV metal of the periodic table.

9. The swell packer of claim 1, comprising a plurality of flutes formed in the first ring and the second ring, wherein each of the plurality of flutes extends through the shoulder.

10. A swell packer for quickly slipping into a wellbore, comprising:

a. a swellable wellbore packer section comprising:

(i) a substantially cylindrical body; and (ii) a swellable member disposed on the substantially cylindrical body, the swellable member comprising a material selected to expand on exposure to at least one triggering fluid to create a seal in the wellbore;

b. a pair of end rings sealingly engage the substantially cylindrical body to the swellable wellbore packer section, wherein each of the end rings forms an annular abutment surface that cooperates with the swellable member to inhibit axial movement of the swellable member on the substantially cylindrical body, wherein each of the end rings comprises a first ring and a second ring, a shoulder having a circumferentially contiguous interior surface between the first ring and the second ring, and fasteners mounted through the first ring and the second ring respectively; and c. a plurality of polyamide buttons installed circumferentially and spaced apart symmetrically or near-symmetrically on at least one of the end rings.

11. The swell packer of claim 10, wherein the polyamide buttons are nylon.

12. The swell packer of claim 10, wherein each of the end rings further comprises an end ring lip that extends further away from the substantially cylindrical body than the swellable member.

13. The swell packer of claim 10, further comprising a plurality of cutting ridges formed on at least one of the end rings.

14. The swell packer of claim 10, wherein each of the polyamide buttons has a diameter from 50 percent to 100 percent of the width of the second ring.

15. The swell packer of claim 10, wherein each of the polyamide buttons extends away from the end ring by 0.001 millimeters to 3 millimeters.

16. The swell packer of claim 10, further comprising a metal ring around at least one of the polyamide buttons.

17. The swell packer of claim 16, wherein the metal ring comprises a thickness that is from 10 percent and 50 percent the thickness of the polyamide button.

18. The swell packer of claim 10, comprising a plurality of flutes formed in the first ring and the second ring, wherein each of the plurality of flutes extends through the shoulder.

19. A swell packer for simultaneously cutting and quickly slipping into and sealing a wellbore, comprising:

a. a swellable wellbore packer section comprising:

(i) a substantially cylindrical body; and a (ii) swellable member disposed on the substantially cylindrical body, the swellable member comprising a material selected to expand on exposure to at least one triggering fluid to create a seal in the wellbore;

b. a pair of end rings sealingly engage the substantially cylindrical body to the swellable wellbore packer section, wherein each of the end rings forms an annular abutment surface that cooperates with the swellable member to inhibit axial movement of the swellable member on the substantially cylindrical body, wherein each of the end rings comprises a first ring and a second ring, a shoulder having a circumferentially contiguous interior surface between the first ring and the second ring, and fasteners mounted through the first ring and the second ring respectively; and c. a plurality of tungsten carbide blocks installed circumferentially and spaced apart symmetrically or near-symmetrically on at least one of the end rings.

20. The swell packer of claim 19, wherein each of the end rings further comprises an end ring lip that extends further away from the substantially cylindrical body than the swellable member.

21. The swell packer of claim 19, further comprising a plurality of cutting ridges formed on at least one of the end rings.

22. The swell packer of claim 19, wherein each of the tungsten carbide blocks has a diameter from 50 percent to 100 percent of the width of the second ring.

23. The swell packer of claim 19, wherein each of the tungsten carbide blocks extends away from the end ring by 0.001 millimeters to 3 millimeters.

24. The swell packer of claim 19, comprising a plurality of flutes formed in the first ring and the second ring, wherein each of the plurality of flutes extends through the shoulder.

* * * * *